US010240392B2

(12) United States Patent
Roddenby

(10) Patent No.: US 10,240,392 B2
(45) Date of Patent: Mar. 26, 2019

(54) VERTICALLY ORIENTED LADDER APPARATUS FOR ALLOWING A CLIMBER TO ADOPT AN IMPROVED CLIMBING STANCE IN USE

(71) Applicant: Glenn Roddenby, Lightning Ridge (AU)

(72) Inventor: Glenn Roddenby, Lightning Ridge (AU)

( * ) Notice: Subject to any disclaimer, the term of this patent is extended or adjusted under 35 U.S.C. 154(b) by 0 days.

(21) Appl. No.: 15/534,769

(22) PCT Filed: Nov. 27, 2015

(86) PCT No.: PCT/AU2015/050749

§ 371 (c)(1),
(2) Date: Jun. 9, 2017

(87) PCT Pub. No.: WO2016/094937

PCT Pub. Date: Jun. 23, 2016

(65) Prior Publication Data

US 2017/0342772 A1 Nov. 30, 2017

(30) Foreign Application Priority Data

Dec. 15, 2014 (AU) ..... 2014905077
Mar. 13, 2015 (AU) ..... 2015900904

(51) Int. Cl.
*E06C 1/38* (2006.01)
*E06C 7/08* (2006.01)
(Continued)

(52) U.S. Cl.
CPC ..... *E06C 1/38* (2013.01); *E06C 1/20* (2013.01); *E06C 1/34* (2013.01); *E06C 1/381* (2013.01);
(Continued)

(58) Field of Classification Search
CPC ... E06C 1/34; E06C 1/38; E06C 7/082; E06C 7/183; E06C 7/185; E06C 1/20;
(Continued)

(56) References Cited

U.S. PATENT DOCUMENTS 2,539,664 A * 1/1951 Hay ..... E06C 7/185 182/106
4,199,040 A * 4/1980 Lapeyre ..... B63B 29/20 182/93
(Continued)

FOREIGN PATENT DOCUMENTS

CN 202125237 U 1/2012
DE 224367 7/1985
(Continued)

OTHER PUBLICATIONS

International Search Report & Written Opinion dated Dec. 17, 2015 from corresponding International PCT Application No. PCT/AU2015/050749.

*Primary Examiner* — Colleen M Chavchavadze
*Assistant Examiner* — Shiref M Mekhaeil
(74) *Attorney, Agent, or Firm* — Innovation Capital Law Group, LLP; Vic Lin

(57) ABSTRACT

A vertically orientated ladder apparatus allowing a climber to adopt an improved climbing stance wherein the climber's arms are poised economically in front of the climber within the climbing passage; the climber's legs are spread for the lateral stability of the climber so as to reduce the tendency of the climber falling sideways; and the climber is substantially upright such that the climber's center of gravity lies substantially between the opposing steps (11) so as to allow the climber to release the climber's grip on the hand rails (14) while remaining balanced and supported by the legs of
(Continued)

the climber. Opposing steps (11) are level or staggered. Embodiments include three or four stiles (12, 15).

11 Claims, 14 Drawing Sheets

(51) Int. Cl.
*E06C 1/20* (2006.01)
*E06C 7/18* (2006.01)
*E06C 9/02* (2006.01)
*E06C 1/34* (2006.01)

(52) U.S. Cl.
CPC ..... *E06C 7/08* (2013.01); *E06C 7/082* (2013.01); *E06C 7/182* (2013.01); *E06C 7/183* (2013.01); *E06C 7/185* (2013.01); *E06C 9/02* (2013.01)

(58) Field of Classification Search
CPC . E06C 1/381; E06C 7/08; E06C 7/182; E06C 9/02; E02D 29/12; E04F 11/022; E04F 11/0223; E04F 11/0226; E04F 11/025; E04F 11/028; E04F 11/0201
See application file for complete search history.

(56) References Cited

U.S. PATENT DOCUMENTS 4,316,524 A * 2/1982 Lapeyre ..... E06C 1/38 182/106
4,509,617 A * 4/1985 Lapeyre ..... E06C 1/38 182/106
4,535,871 A * 8/1985 Lapeyre ..... E04F 11/028 182/106
4,981,195 A * 1/1991 Merrick ..... E06C 1/381 182/100
5,085,291 A * 2/1992 Narramore ..... E06C 1/20 182/106
5,255,758 A * 10/1993 Hood, Jr. ..... E06C 7/185 182/106
6,386,320 B1 * 5/2002 Clavel ..... E06C 1/382 182/106
6,929,094 B1 * 8/2005 Kohlmeier ..... E06C 7/185 182/106
8,381,877 B1 * 2/2013 Freund ..... E06C 1/10 182/116
D777,947 S * 1/2017 Simmons ..... D25/64
2005/0189172 A1 * 9/2005 Becker ..... E04G 5/10 182/106
2010/0313516 A1 * 12/2010 Kreller ..... E04G 11/48 52/693
2011/0209947 A1 * 9/2011 Allred, III ..... E04C 3/40 182/194
2014/0144006 A1 * 5/2014 Ashouri ..... E06C 7/50 29/525.08
2015/0114755 A1 * 4/2015 Eames ..... E06C 1/39 182/207
2016/0017657 A1 * 1/2016 Wilson ..... E06C 1/10 182/178.2

FOREIGN PATENT DOCUMENTS

EP 1741873 A1 1/2007
JP S4891895 A 11/1973
WO 2013105880 A2 7/2013

* cited by examiner

VERTICALLY ORIENTED LADDER APPARATUS FOR ALLOWING A CLIMBER TO ADOPT AN IMPROVED CLIMBING STANCE IN USE

FIELD OF THE INVENTION

The present invention relates to ladders and in particular, but not necessarily entirely, to a vertically orientated ladder apparatus.

SUMMARY OF THE DISCLOSURE

According to one aspect, there is provided a vertical step ladder comprising two vertical side stiles and two vertical front stiles, the two front stiles being closer together than the two side stiles.

The ladder also comprises two vertical sets of inwardly jutting horizontal half treads spaced apart for climbing therebetween. Each half tread may be fixed to respective inner sides of the two vertical side stiles.

Furthermore, the ladder may have horizontal rung members each having a straight portion connected between the two front stiles and a side portion adjacent two front stiles. The side portion bends at a right angle to terminate at a respective half tread.

The rung members may be being alternately oppositely staggered such that spacing between adjacent side portions is twice that between adjacent front portions.

Each half tread may be fixed at a middle portion thereof to the respective inner sides of the two vertical side stiles.

Each half tread may have a horizontal plate for stepping upon and a lateral orthogonal flange connecting a respective inner side of the two vertical side stiles.

Each side portion may be connected under a respective horizontal plate.

Each horizontal plate may be connected at an inner edge of the respective horizontal plate.

Straight portions of the rungs may be connected to rearward sides of the two vertical front stiles.

The rungs may be tubular.

The ladder may further comprise a vertical section wherein adjacent rungs do not span between the two front stiles so that a climber can enter and exit the ladder between the two vertical front stiles.

The two vertical side stiles may terminate in connections for connecting an adjacent set of two vertical side stiles in use. The connections may comprise overlapping connection plates which may locate at an outer side of each respective vertical stile and each have apertures which collocate for the insertion of a fastener therethrough.

Other aspects of the invention are also disclosed.

BRIEF DESCRIPTION OF THE DRAWINGS

Notwithstanding any other forms which may fall within the scope of the present invention, a preferred embodiments of the disclosure will now be described, by way of example only, with reference to the accompanying drawings in which.

DESCRIPTION OF EMBODIMENTS

Figure 1:
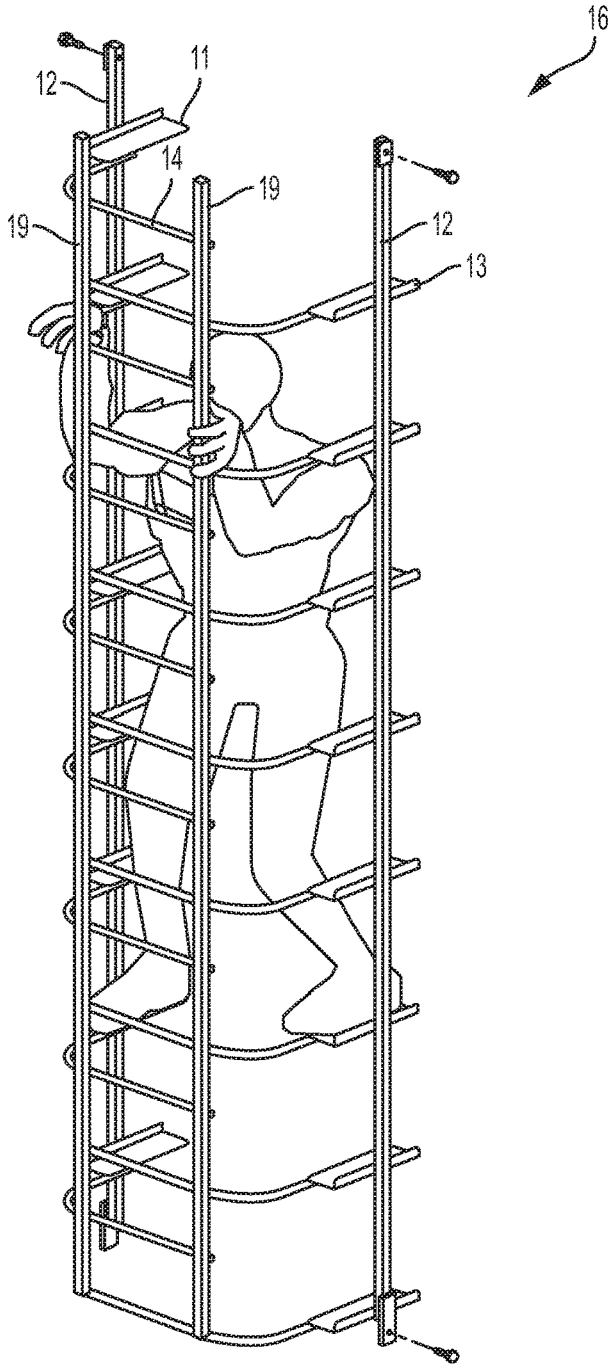
FIG. 1 shows a climber climbing a vertical step ladder in accordance with a first embodiment.
Figure 2:
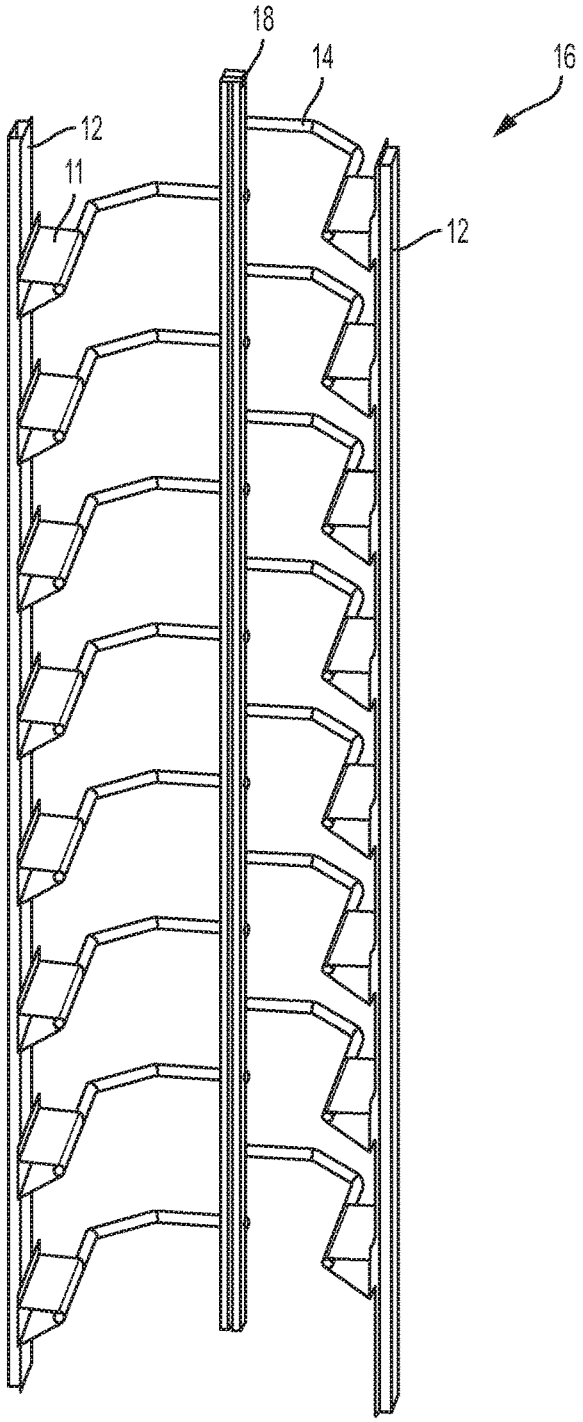
FIG. 2 shows a vertical step ladder in accordance with a second embodiment.
Figure 3:
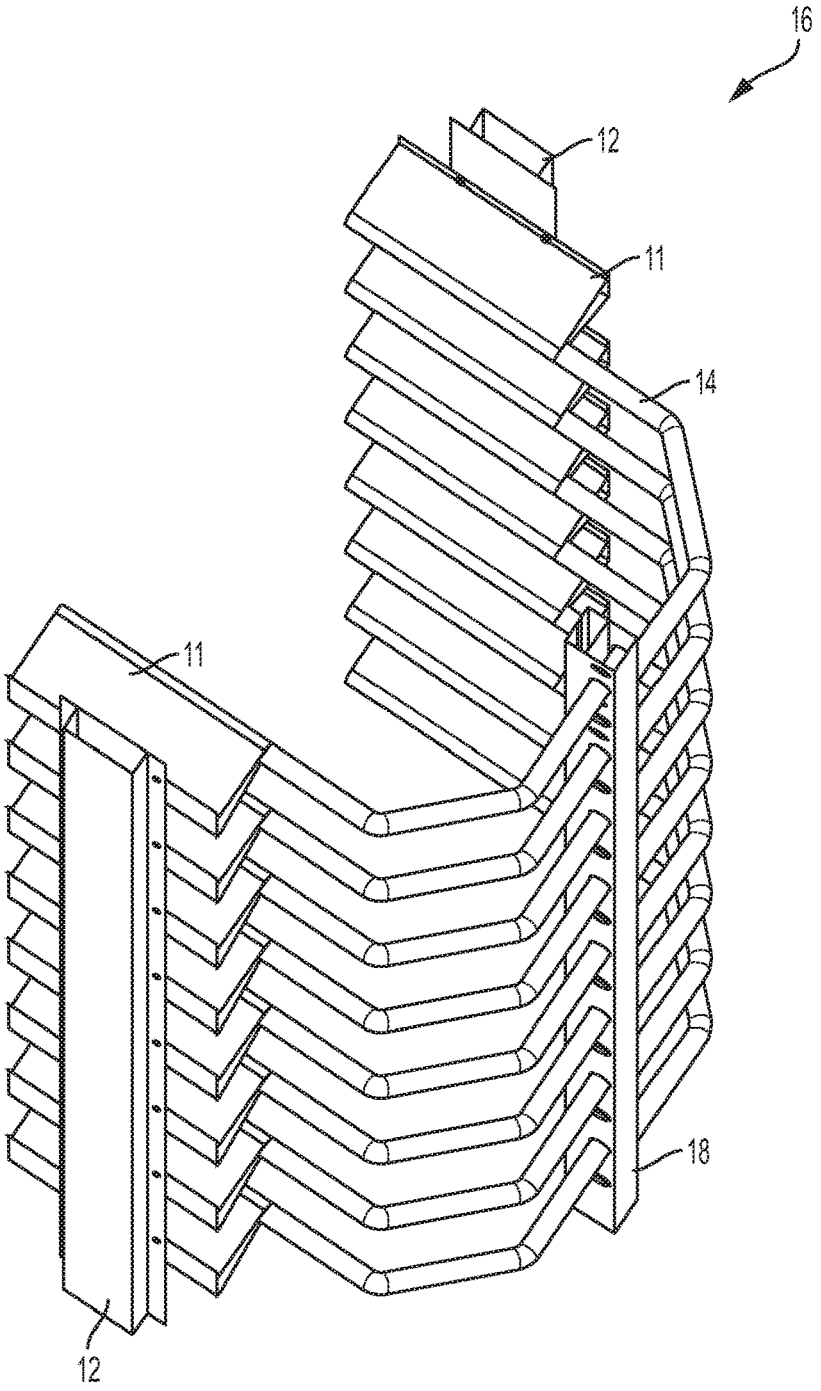
FIG. 3 shows a top perspective view of the step ladder of the second embodiment.
Figure 4:
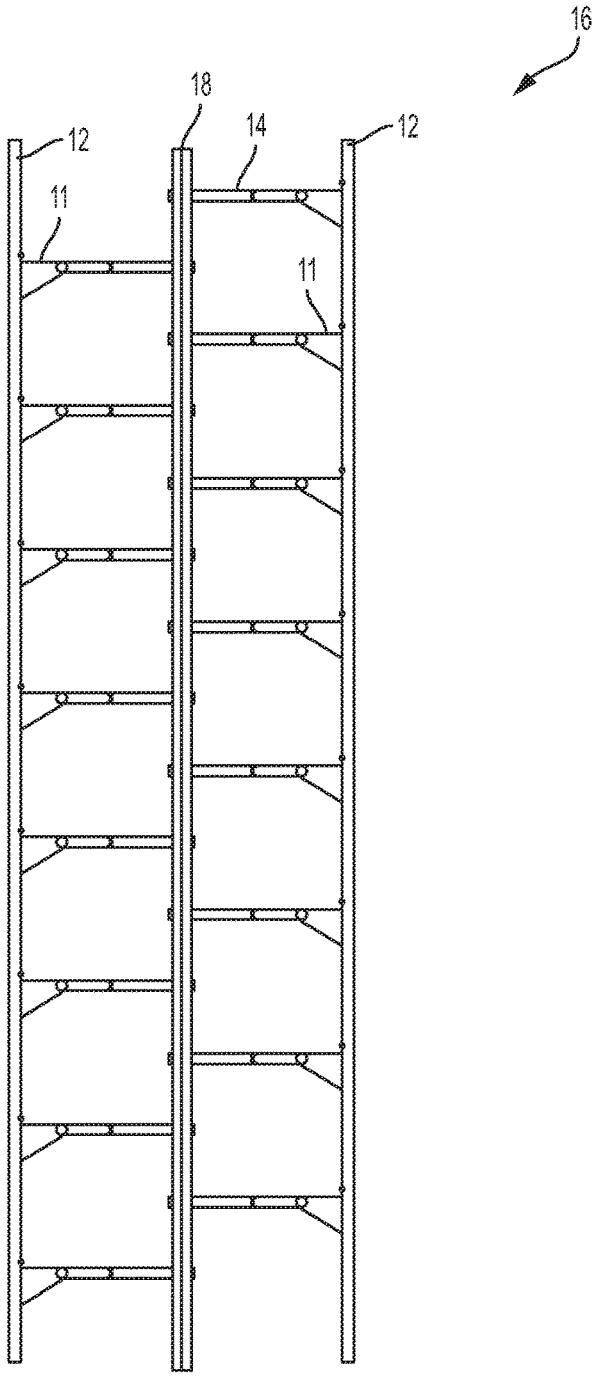
FIG. 4 shows a rear elevation view of the stepladder of the second embodiment.
Figure 5:
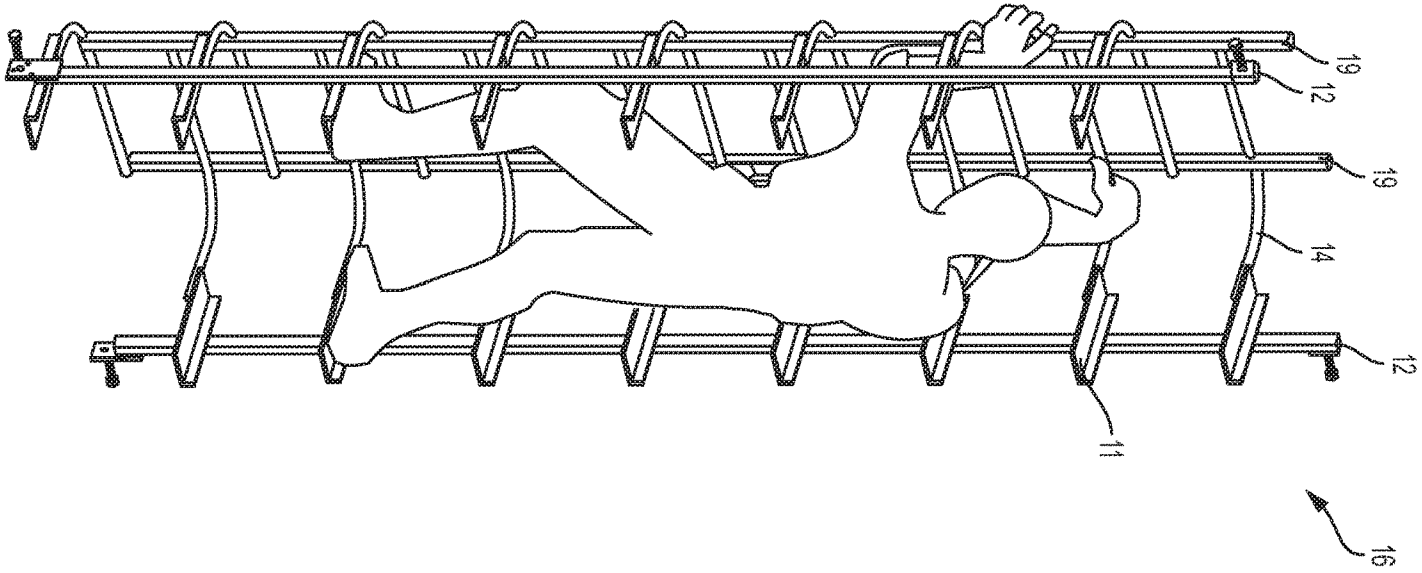
FIG. 5 shows a rear perspective view of the vertical step ladder according to the first embodiment.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure.

Before the structures, systems and associated methods relating to the vertically orientated ladder apparatus are disclosed and described, it is to be understood that this disclosure is not limited to the particular configurations, process steps, and materials disclosed herein as such may vary somewhat. It is also to be understood that the terminology employed herein is used for the purpose of describing particular embodiments only and is not intended to be limiting since the scope of the disclosure will be limited only by the claims and equivalents thereof.

In describing and claiming the subject matter of the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterised by," and grammatical equivalents thereof are inclusive or open-ended terms that do not exclude additional, unrecited elements or method steps.

It should be noted in the following description that like or the same reference numerals in different embodiments denote the same or similar features.

Turning now to FIG. 1, there is shown a vertically orientated ladder 16 in accordance with a preferred embodiment of the present disclosure. As will become apparent from the ensuing description, the ladder 16 eliminates or at least substantially ameliorates problems of conventional arrangements, including those described above relating to safety, climber fatigue, usability and the like.

Specifically, as will be described in further detail below, the ladder 16 is configured for allowing the climber to adopt an improved climbing stance conferring the above advantages in safety and usability.

As is shown in FIG. 1, the ladder apparatus 16 comprises a pair of laterally positioned and vertically orientated stiles 12.

Figure 8:
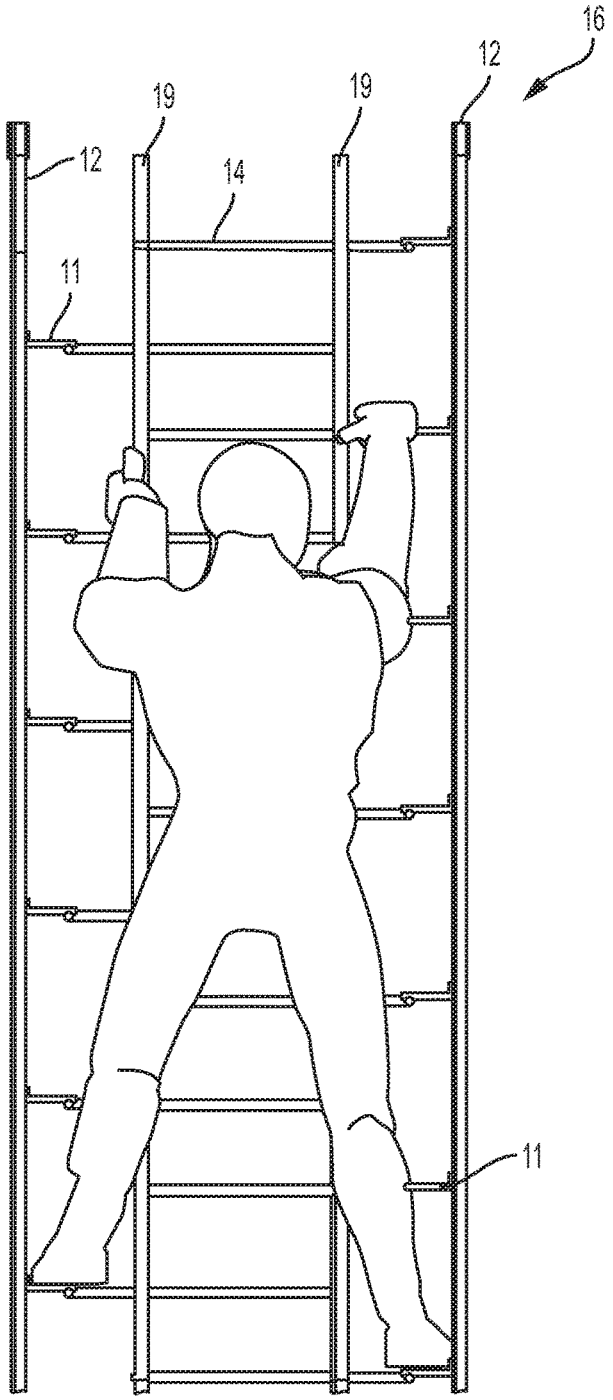
FIG. 8 shows a rear elevation view of the vertical step ladder according to the first embodiment.

The ladder 16 further comprises opposing horizontal steps 11 immovably fixed to respective inner faces of the lateral stiles 12. Turning to FIG. 8, as can be seen, the horizontal steps 11 project inwardly such that each step is laterally useable for stepping on and off by the climber using lateral step movements of each respective foot of the climber as the climber climbs the ladder. Considering again the FIG. 1, in embodiments, the horizontal steps 11 may comprise an edge flange 13 to limit the lateral movement of the foot of the climber in use.

Furthermore, the ladder 16 comprises hand rungs 14 extending between the stiles 12.

Improved Climbing Stance

Now, as alluded to above, the configuration as substantially shown in FIG. 1 allows the climber to adopt an improved climbing stance when compared to conventional ladder arrangements.

As can be seen, the steps are spaced apart laterally so as to define a vertical climbing passage therebetween.

Figure 7:
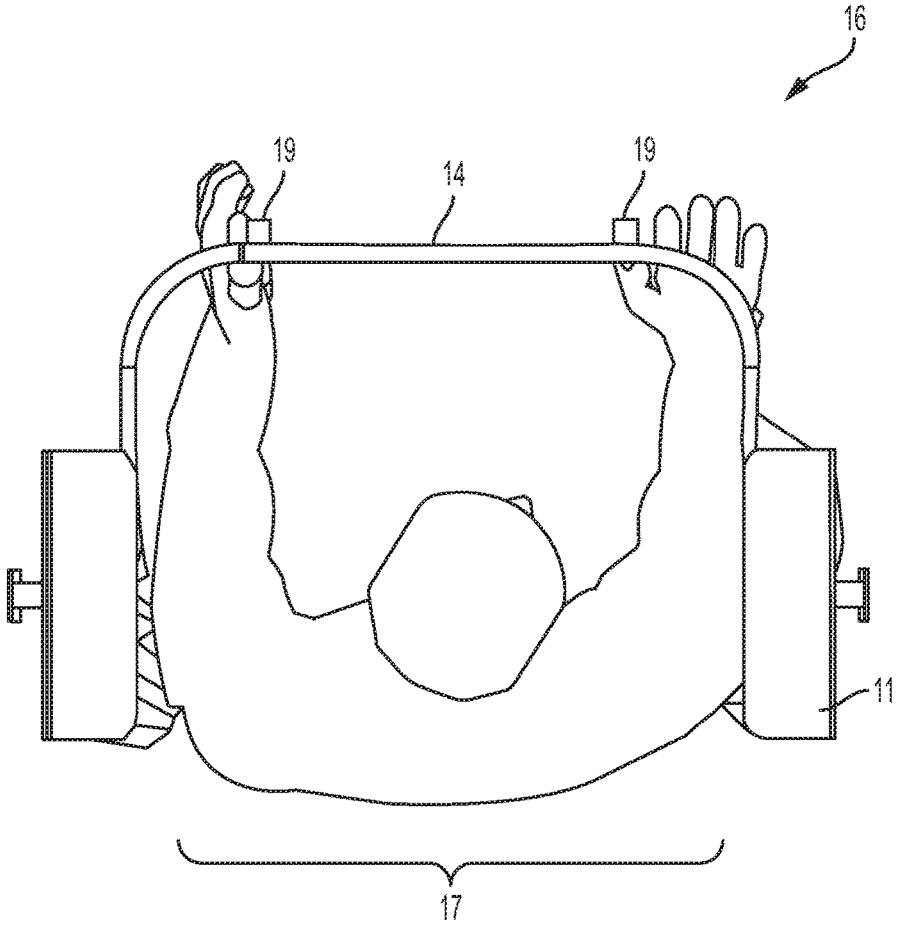
FIG. 7 shows a top plan view of the vertical step ladder according to the first embodiment.

Specifically, turning to FIG. 7, there is shown a top view of the ladder apparatus 16 in use. As can be seen, the climbing passage 17 is sufficiently wide so as to fit at least the shoulders of the climber between the opposing steps. As can also be seen from FIG. 7, the arms of the climber extend forwards between the horizontal steps 11. In this manner, and as will be discussed in further detail below, the hand rungs 14 allocated suitably forward of the climber in use so as to allow the ergonomic gripping and use thereof. Specifically, the ergonomic use thereof comprises at least one of 1) the provision of sufficient space to allow the climber to move the climber's arms within the lateral edges of the climbing passage between the horizontal steps 11 and 2) the climber being able to grip the rungs most proximate with the shoulders of the climber with comfortably bent arms and to be able to reach and subsequently grip adjacent upper and lower hand rungs 14 with straight arms.

Similarly, turning now to FIG. 8, there is shown a rear elevation view of the ladder 16 in use showing the spacing apart of the opposing steps 11 so as to allow a sufficiently wide climbing passage to fit at least the shoulders of the climber.

As can be seen, the hand rungs 14 are located sufficiently forwards so as to allow for the ergonomic gripping thereof. Specifically, as can be seen, the user's arms are forwardly orientated so as to fit between the horizontal steps 11 and naturally bent so as to easily grip the hand rungs 14 in front of the climber and allow the climber to reach the next adjacent above and below hand rungs with straighter arms.

Specifically, the extent of the forward location of the rungs 11 lies between the full extent of the length of the climber's arms and the shoulders of the climber so as to allow the climber to reach the hand rungs 14 substantially coinciding with the shoulders of the climber with bent arms and so as to allow the reaching of the upper and lower rungs 11 with straight arms.

Now, and referring again to FIG. 1, the above-described configuration of the ladder 16 allows the climber to adopt the improved climbing stance as a substantially provided in FIG. 1.

As can be seen, the climber's torso is substantially vertically orientated with the vertical axis of the ladder. In other words, the torso of the climber is orientated as if the climber was standing naturally.

By positioning the torso of the climber substantially vertically, the ladder 16 advantageously reduces the climber's reliance on the climber's hands for holding onto the ladder 16. Specifically, as can be appreciated, and in making reference to FIG. 1 showing the conventional vertical ladder arrangement the torso of the climber is inclined away from the ladder placing strain on the arms of the climber. As such, with the prior art arrangement of FIG. 1, should the climber let go of the rungs, even momentarily, the climber would topple backwards on account of the inclined torso angle and immediately fall from the ladder 1.

However, in considering again FIG. 1, by positioning the torso of the climber substantially vertically, reliance on gripping the hand rungs 14 is reduced or eliminated entirely. Specifically, as can be appreciated from FIG. 1, the climber is able to let go of the rungs and even climb the ladder 16 without holding onto the rungs.

In this manner, the ladder 16 provides advantages in safety in that were the climber to let go of the hand rungs 14 the climber would not fall from the ladder 16. Furthermore, the ladder 16 allows the climber to carry items with hands freed from not being necessarily required to hold onto the rails 14.

Furthermore, in the improved climbing stance, the climber's arms are able to selectively grip the hand rungs in an ergonomic manner. Specifically, as alluded to above, the hand rungs are positioned sufficiently forwards so as to allow the climber to grip the hand rungs 14 most proximate with the shoulders of the climber with bent arms in a comfortable and ergonomic manner and so as to be able to straighten the climber's arms to reach the next upper and lower hand rungs 14.

As can be appreciated, with conventional vertical ladder arrangements such as that which is shown in FIG. 1, were the climber to attempt to position the climber's torso vertically, the climber would be required to bring the climber's arms right in such that the rungs lie substantially against the climber shoulders which is a non-ergonomic.

Furthermore, as can be seen, the spacing apart of the opposing steps 11 spreads the legs of the climber. As such, in the improved climbing stance, the climber has spread apart legs for lateral stability. Again, with conventional vertical ladder arrangements such as that which is provided in FIG. 1, the ladders 1 are typically narrow requiring the climber's feet to be placed substantially adjacent each other. In this manner, climbers often fall sideways from ladders by leaning too far to one side, such as when reaching for objects or when taking steps up the ladder. In this regard, should be noted that the ladder 16 yet allows the climber to reach across from the ladder 16 wherein the climber can insert the climber's arms between the hand rungs 14 while still remaining stable with the spaced apart foot stance.

Figure 6:
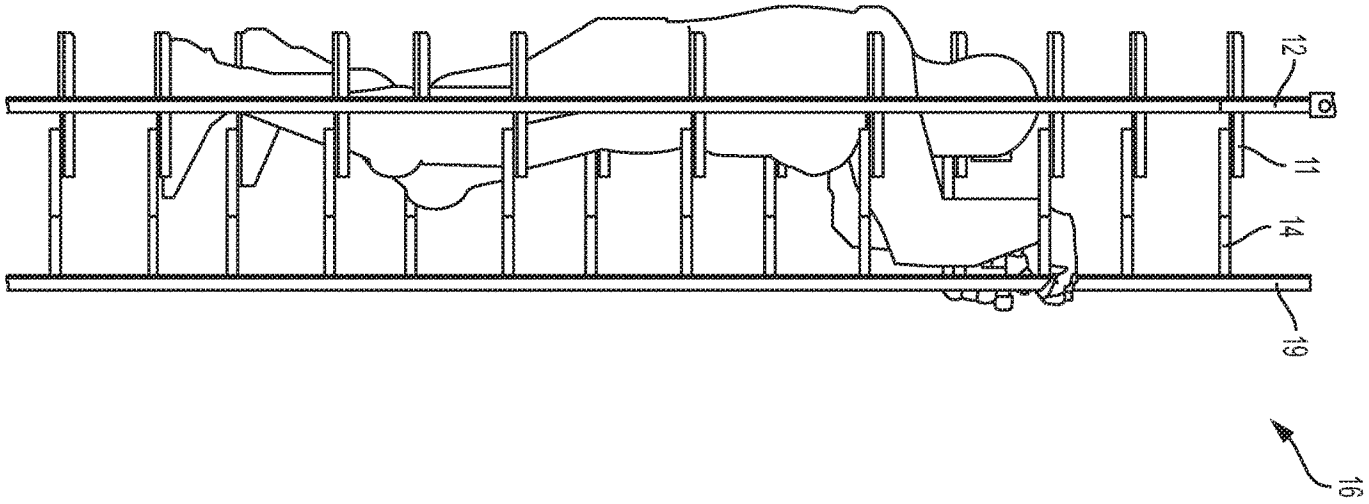
FIG. 6 shows a side elevation view of the vertical step ladder according to the first embodiment.

Furthermore, in the improved climber stance, the climber's centre of gravity lies substantially between the opposing steps 11 so as to prevent falling should the climber let go of the hand rungs 14. Specifically, turning to FIG. 6, there is shown a side elevation view of the ladder 16 in use. As can be seen, the centre of gravity of the climber lies substantially between the steps 11. In this manner, the climber can let go of the hand rungs 11 and yet remain balanced on the steps.

Such a stance should be compared to the embodiment shown in FIG. 1 of the conventional vertical runged ladder arrangement wherein, as can be seen, the climber's centre of gravity lies behind the rungs of the ladder.

Various Embodiments

It should be noted that the ladder 16 may take on differing shapes and configurations within the purposive scope of the embodiments described herein.

Figure 9:
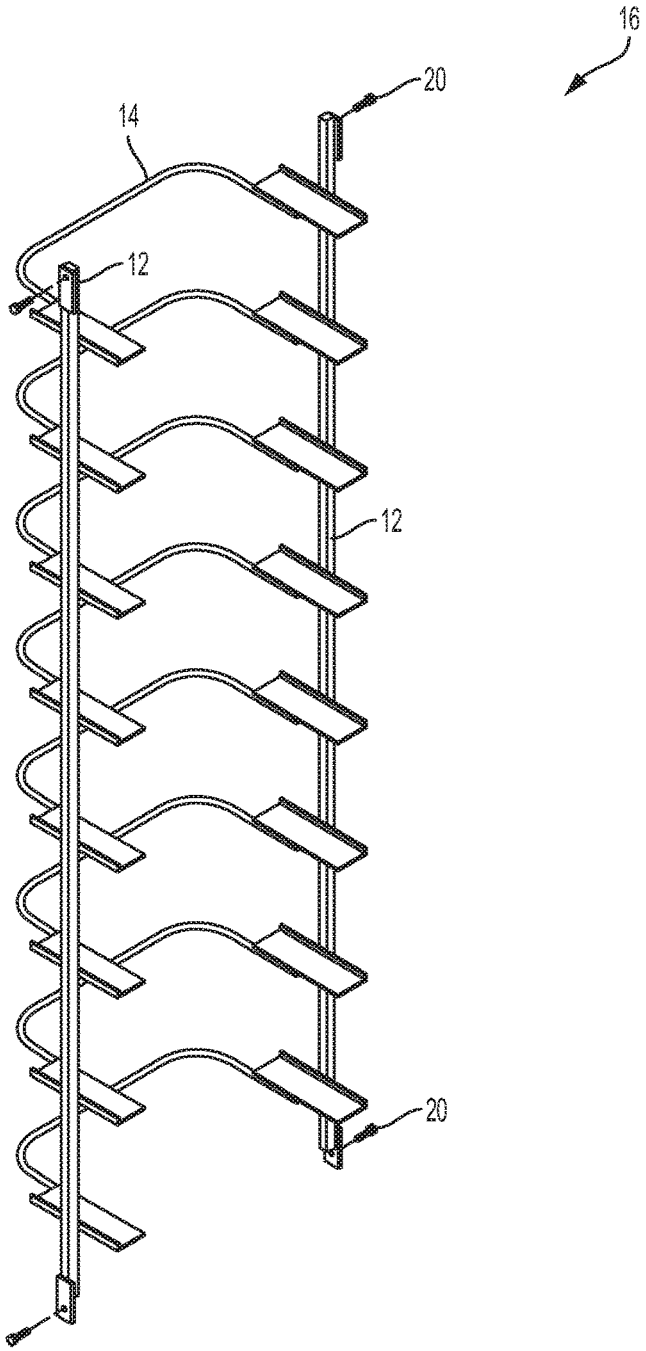
FIG. 9 shows a rear perspective view of a vertical step ladder in accordance with third embodiment.

Specifically, turning to FIG. 9, there is shown a first embodiment of the ladder 16. As can be seen, the ladder 16 comprises relatively few components and material so as to provide a lightweight ladder structure. Specifically, in this embodiment shown in FIG. 9, the hand rungs 14 extend between vertically opposite steps 11 comprising the substantial U-shaped horizontal cross-section as is shown in the figure so as to locate the rails 14 sufficiently forward so as to allow the economic use thereof by the climber.

Figure 10:
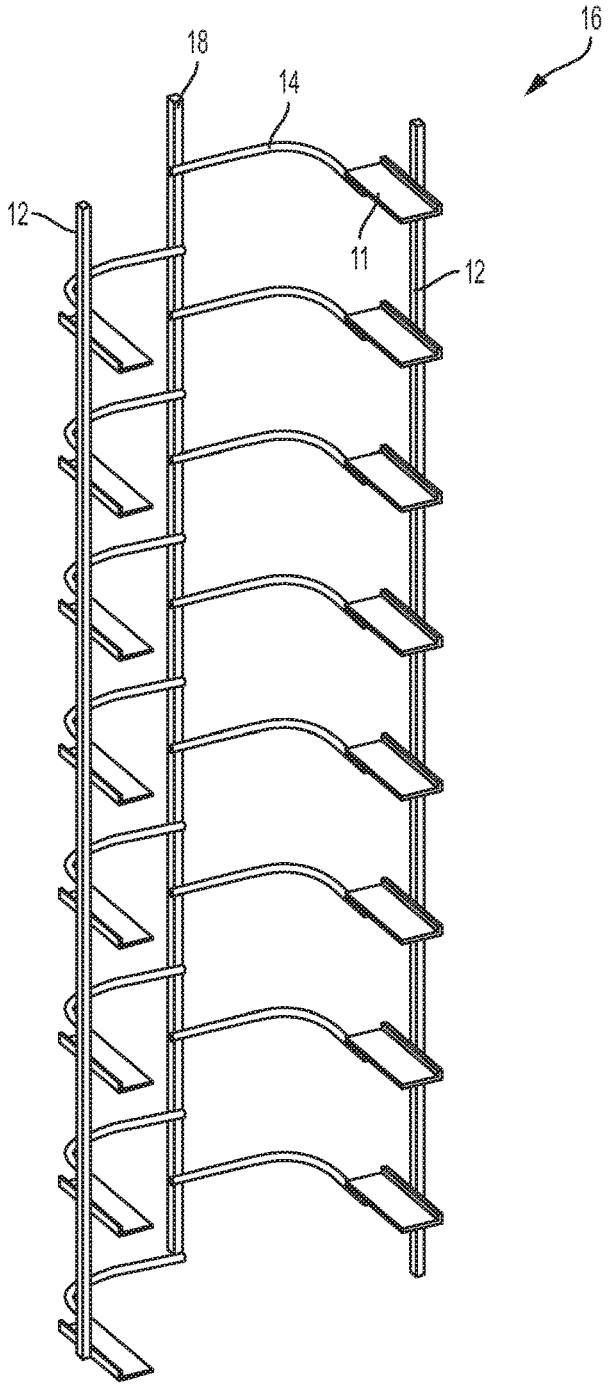
FIG. 10 shows a rear perspective view of a vertical step ladder in accordance with fourth embodiment.

FIG. 10 shows a further embodiment of the ladder 16 wherein, as is immediately apparent, the steps 11 are alternately vertically staggered. Such staggering advantageously allows for the halving of the number of steps 11 required as compared to the embodiment is provided in FIG. 9.

As is also apparent from the embodiment in FIG. 10, the ladder 16 comprises a forwardly located central stile 18 to which the corresponding alternating rails 14 from the corresponding steps 11 are fastened. As such, in this embodiment, each rail 14 comprises a substantial L shape in the horizontal plane so as to traverse through the 90° orientation to connect to the central stile 18 and the sidesteps 11.

Figure 11:
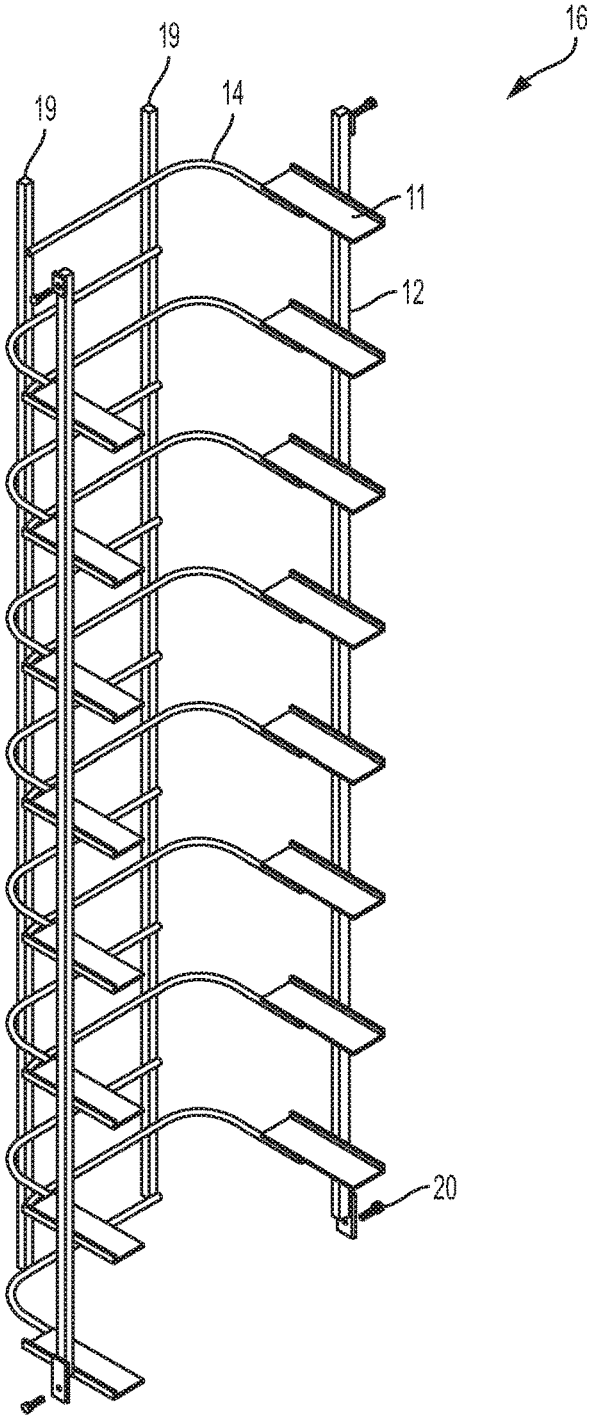
FIG. 11 shows a rear perspective view of the vertical step ladder according to the first embodiment.

FIG. 11 shows a yet further embodiment of the ladder 16 wherein, as can be seen, the ladder 16 similarly comprises the alternating steps 11 but not necessarily so. One distinguishing aspect of the ladder 16 of FIG. 11 is that the ladder 16 comprises a pair of central forwardly located stiles 19.

The pair of centrally forward located stiles 19 reinforces the ladder 16 further increasing the rigidity thereof and the weight-bearing capabilities of the ladder 16. Furthermore, the centrally forward located stiles 19 allow the fasting of the ladder 16 to a building structure by the stiles 19.

Connection to Adjacent Ladder Sections

As can be seen from the embodiments presented present in at least FIGS. 9 and 11, the ends of the stiles 12 comprise fasteners for fastening to adjacent sections of ladder 16. In this manner, the ladder 16 may be manufactured in sections so as to allow the construction of a ladder assembly 16 utilising adjoining ladder sections 16 so as to reach differing desired heights.

Figure 12:
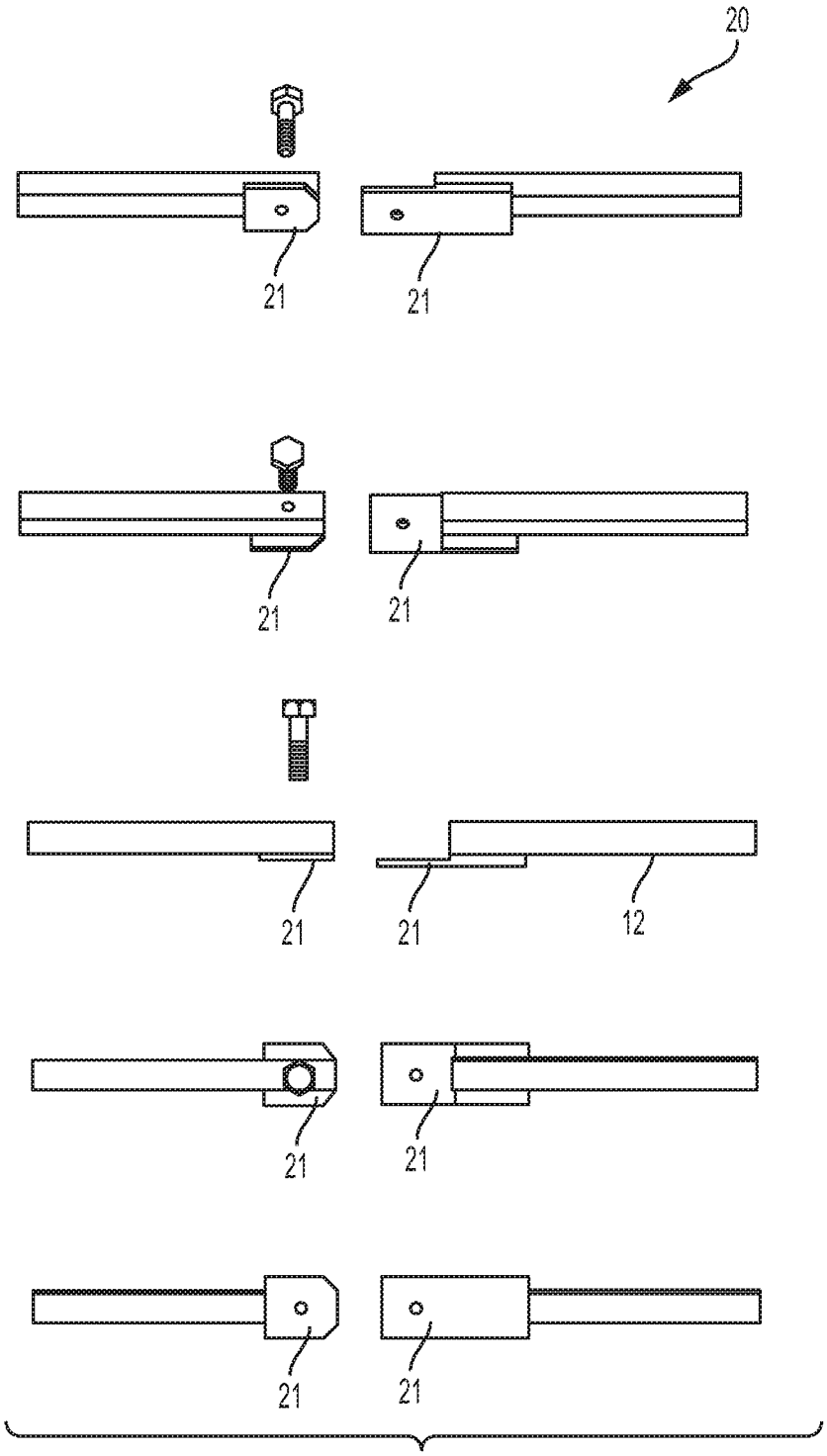
FIG. 12 shows stile connections.

Specifically, FIG. 12 shows various views of an exemplary mechanical connection located at the respective distal ends of the stiles 12 for fastening to adjacent ladder sections. As can be appreciated, the fasteners comprise offset fish plates 21 so as to allow the ends of the stile 12 to abut against each other so as to allow for the transfer of weight through the ends of the stiles 12 so as to not hinder the weight-bearing capabilities of the ladder 16 when fastened in this manner.

Upper End Gate

Figure 13:
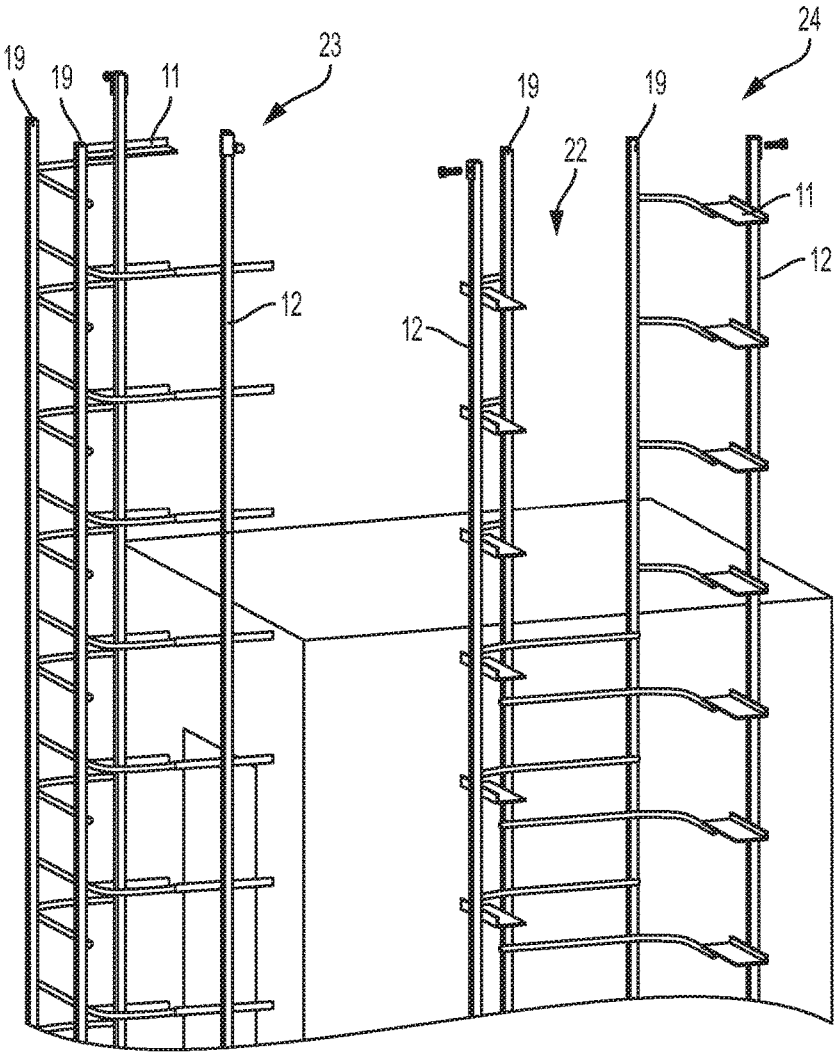
FIG. 13 illustrates the attachment of vertical step ladders of the first embodiment to the top building structure.

Turning now to FIG. 13, there is shown an embodiment of the ladder 16 wherein the ladder 16 has been configured so as to allow the transitioning of the climber from the ladder to a raised platform.

Specifically, as can be seen in the figure, the ladder 16 may be arranged in a forward facing configuration 24 such that, when climbing the ladder 16, the climber faces the building.

However, when reaching the raised platform, so as to negate the need for the climber to climb around the lateral stiles 12, or to be deprived of hand rungs above the upper surface of the platform, as can be seen in the embodiment shown, the central portions of the hand rails 14 have been removed so as to define an upper end gate 22 to allow the climber to step forwards through the ladder 16 to step onto the platform.

As is also shown the ladder 16 may be arranged in the rearward facing configuration 23 wherein the climber faces away from the building. As such, when reaching the elevated platform the climber need only turn around so as to step onto the platform.

Bottom End Gate

In a similar manner as was described with reference to FIG. 13, in embodiments, the ladder 16 may be configured with a bottom end gate.

Figure 14:
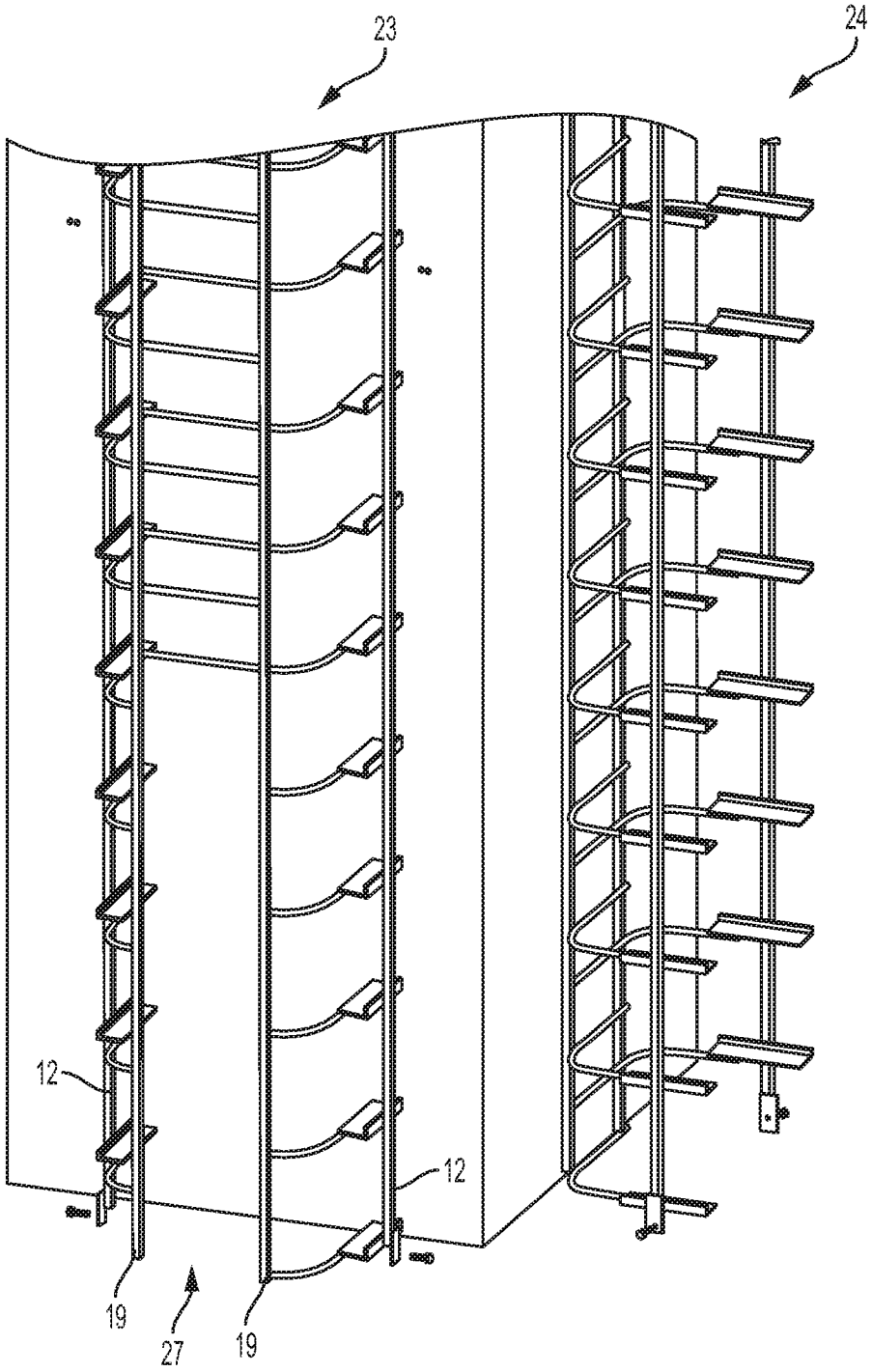
FIG. 14 illustrates the attachment of vertical step ladders of the first embodiment to the bottom of a building structure.

Specifically, FIG. 14 show such an embodiment wherein, as can be seen, in one manner the ladder 16 may be arranged in the rearward facing configuration 27 such that the climber faces away from the building.

In this embodiment, and so as to allow the climber to enter the climbing passage between the steps 14, the central portions of the bottom hand rungs 14 have been removed so as to create a bottom gate 27.

In an alternative embodiment wherein the ladder 25 has been provided in the forward facing configuration 24, the rungs 11 need not be modified as the climber may simply step onto the ladder 16.

As can be appreciated, for the forward facing configuration 24, an upper gate need only be required. Conversely, for the rearward facing configuration 27, a lower gate 27 would only be required.

It should be noted that in embodiment, such as for application within wind generators and the like the ladder 26 may be twist about the central axis so as to transition between rotationally offset entrance and exits of the ladder without requiring a bottom gate 27 or upper gate 22.

Interpretation

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to the ladder industries.

The invention claimed is:

1. A vertical step ladder comprising two vertical side stiles and two vertical front stiles, the two front stiles being closer together than the two side stiles, two vertical sets of inwardly extending horizontal half treads spaced apart for climbing therebetween, horizontal rung members each having a front portion connected between the two front stiles and a side portion which bends at a right angle adjacent one of the two front stiles to fix a respective half tread between a terminus of the side portion and an inner side of a respective vertical side stile where each rung member is not directly connected with either of the two vertical side stiles, the side portions of vertically adjacent horizontal rung members being located adjacent opposite side stiles such that spacing between vertically adjacent side portions is greater than that between vertically adjacent front portions.

2. The vertical step ladder as claimed in claim 1, wherein each half tread is fixed at a middle portion thereof to an inner side of the respective vertical side stile.

3. The vertical step ladder as claimed in claim 1, wherein each half tread comprises a horizontal plate for stepping upon and a lateral upright orthogonal flange at an inner side of the respective vertical side stile.

4. The vertical step ladder as claimed in claim 3, wherein each side portion is connected under a respective horizontal plate.

5. The vertical step ladder as claimed in claim 4, wherein each side portion is connected at an inner edge of the respective horizontal plate.

6. The vertical step ladder as claimed in claim 1, wherein front portions of the rungs are connected to inner sides of the two vertical front stiles.

7. The vertical step ladder as claimed in claim 1, wherein the rungs are tubular.

8. The vertical step ladder as claimed in claim 1, further comprising a vertical section devoid of front portions between the two front stiles.

9. The vertical step ladder as claimed in claim 1, wherein the two vertical side stiles terminate in connections for connecting another set of two vertical side stiles in use.

10. The vertical step ladder as claimed in claim 9, wherein the connections comprise overlapping connection plates.

11. The vertical step ladder as claimed in claim 10, wherein the overlapping connection plates are at outer sides of the respective vertical side stile and each respective connection plate has apertures which collocate for the insertion of a fastener therethrough.

* * * * *